US005107727A

United States Patent [19]

Klefbeck

[11] Patent Number: 5,107,727

[45] Date of Patent: Apr. 28, 1992

[54] CONTAINER CAP REMOVER

[76] Inventor: Robert J. Klefbeck, 3 Dresden Ct., Albany, N.Y. 12203

[21] Appl. No.: 621,824

[22] Filed: Dec. 4, 1990

[51] Int. Cl.[5] ..... B67B 7/18

[52] U.S. Cl. ..... 81/3.4; 81/3.33.466

[58] Field of Search ..... 81/3.2, 3.33, 3.4, 463, 81/464, 465, 466

[56] References Cited

U.S. PATENT DOCUMENTS

| | | | |
|---|---|---|---|
| 2,034,878 | 3/1936 | Podel | 81/3.2 |
| 3,157,074 | 11/1964 | Durkee | 81/466 |
| 3,812,742 | 5/1974 | Polasek | 81/3.33 |
| 4,660,445 | 4/1987 | Windom . | |
| 4,770,069 | 9/1988 | Mikan et al. . | |
| 4,794,801 | 1/1989 | Andrews et al. . | |

*Primary Examiner*—Roscoe V. Parker
*Attorney, Agent, or Firm*—Heslin & Rothenberg

[57] ABSTRACT

A device for removing a cap from a container. The main components include an upper disc, a lower disc and a means for removably attaching the lower disc to the cap of the container. The upper disc has an aperture centrally located therein and a first pin protruding therefrom, and the lower disc has a slot therein and a second pin centrally located protruding therefrom. When the second pin of the lower disc is inserted in the aperture of the upper disc, the first pin of the upper disc is inserted into and is capable of freely rotating through the slot in the lower disc. When the device is attached to a container cap and the upper disc is manually actuated, the first pin freely rotates through the slot until it reaches the end of the slot and contacts a portion of the lower disc and exerts a force on the lower disc. This force in turn exerts a force on the attachment means and on the cap, thus removing the cap.

19 Claims, 2 Drawing Sheets

CONTAINER CAP REMOVER

FIELD OF THE INVENTION

The subject invention relates to a manually actuated device for removing a cap from a container.

BACKGROUND OF THE INVENTION

Containers are frequently encountered which have caps attached to them too tightly to manually remove. One common example is when a cap has been vacuum-sealed to a container, such as containers of jams and jellies, juices, pickles, etc. Numerous methods are used by the ordinary consumer to overcome this problem, such as running the container and cap under hot water, or hitting the cap around its periphery with an object such as a knife. However, such methods are typically time consuming and often dangerous, e.g., if the container is manufactured of glass. Further, some caps are placed so tightly upon a container that they cannot be manually removed by such methods.

In response, certain mechanical devices have been developed which attempt to overcome this problem. An example of such a device is disclosed in Windon U.S. Pat. No. 4,660,445, issued Apr. 28, 1987 . A bottle opener which comprises a domed housing surrounding an adjustable clamp is provided. The adjustable clamp encircles bottle caps of various sizes and is adjusted via a handle located on the outside of the domed housing. The domed housing and the adjustment handle provide leverage for twisting the opener, thereby removing the bottle cap. However, the value of this device is limited by the size of the adjustable clamp, with some caps being too large or too small to be tightly encircled by the clamp. Further, the device is relatively mechanically complicated to use and, depending upon the size of the bottle cap, possibly time consuming to use.

Andrews et al. U.S. Pat. No. 4,794,801, issued Jan. 3, 1989, discloses a somewhat related device, i.e., a bottle cap removal torque tester. A portion of the bottle cap removal torque tester comprises a disc-like chuck with a plurality of radiating teeth on the bottom of the disc. These teeth engage a cap when the chuck is rotated, applying a torque to the cap without slippage of the chuck on the cap. The chuck is attached to the bottle cap in order to determine the amount of torque on the cap. This torque tester, however, is not used to manually remove a cap from a container.

A need continues to exist in the art for a device which provides a quick, simple and effective means for removing a cap from a container.

SUMMARY OF THE INVENTION

Accordingly, a principle object of the present invention is to provide a device for the simple and effective removal of a cap which has been too tightly applied to a container. It is a further object of the subject invention to provide such a device which can be manually actuated.

The main components of the subject invention include an upper section and a lower section, the upper section being rotatable relative to the lower section, means for restricting rotation of the upper section relative to the lower section, and means for removably attaching the lower section to the container cap. When the device is secured to a container cap, counterclockwise rotation of the upper section relative to the lower section applies a momentum based impulse and torque to the lower section and thereby to the container cap, i.e., when the upper section reaches its limit relative to the lower section of counterclockwise rotation established by the restricting means.

In another preferred embodiment of the subject invention, the device for removing a cap from a container comprises an upper section and a lower section, means for rotatably connecting the upper section and the lower section, means for restricting rotation of the upper section relative to the lower section, and means for removably attaching the lower section to the container cap. When the device is secured to a container cap, counterclockwise rotation of the upper section relative to the lower section applies a momentum based impulse and torque to the lower section and thereby to the container cap, i.e., again, when the upper section reaches its limit relative to the lower section of counterclockwise rotation established by the restricting means.

Each of these embodiments of the subject invention can also be used for tightening a cap on a container. When the device is secured to the container cap, clockwise rotation of the upper section relative to the lower section applies the momentum based impulse and torque to the lower section and thereby to the container cap, i.e., when the upper section reaches its limit relative to the lower section of clockwise rotation established by the restricting means.

In one preferred embodiment of the subject invention, the device comprises an upper disc, a lower disc, and a suction cup. The upper disc has an aperture centrally located therein and a first pin protruding from the periphery thereof. The lower disc has a slot in the periphery thereof and a second pin centrally located protruding therefrom. When these components are assembled in a manner such that the second pin of the lower disc is inserted in the aperture of the upper disc and the first pin of the upper disc is inserted into and is capable of freely rotating through the slot in the lower disc, then the device can be used for removing a cap from a container.

The cap is removed by attaching the lower disc of the device to the container cap using the suction cup, preferably centering the suction cup on the cap, and manually actuating the upper disc. This causes the first pin on the upper disc to freely rotate through the slot until it reaches the end of the slot and contacts a portion of the lower disc. The contact with the lower disc exerts a force on the lower disc, which in turn exerts a force on the suction cup. This force is a momentum based impulse and torque, which results in both a driving and a striking force being exerted on the cap by the suction cup. The cap is thus abruptly, but easily, loosened and can then be removed.

BRIEF DESCRIPTION OF THE DRAWINGS

These and other objects, features and advantages of the invention will be evident from the following detailed description of one preferred embodiment when read in conjunction with the accompanying drawings in which.

DETAILED DESCRIPTION OF THE INVENTION

Figure 1:
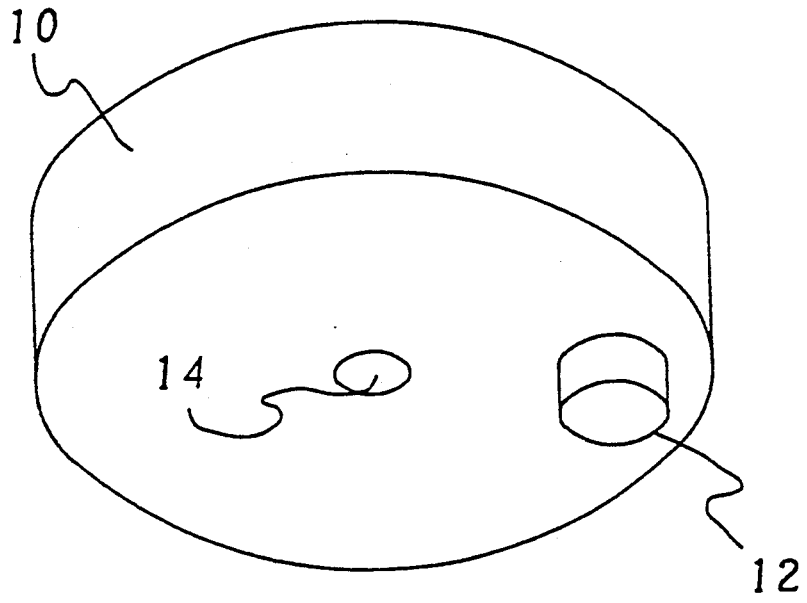
FIG. 1 is a perspective view of the upper disc of one embodiment of the subject invention.
Figure 2:
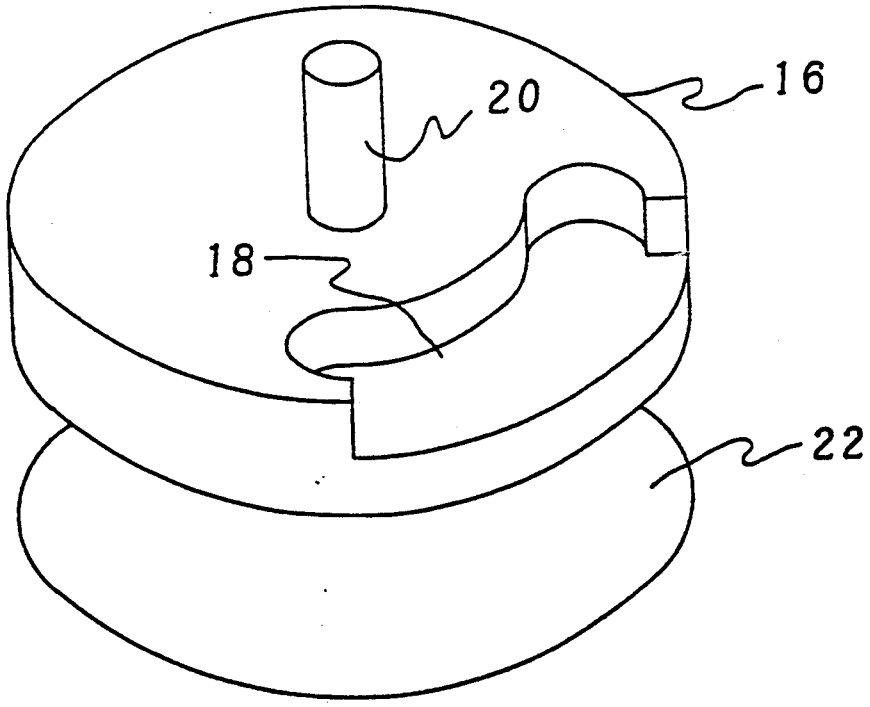
FIG. 2 is a perspective view of the lower disc and suction cup of one embodiment of the subject invention.

The main components of one preferred embodiment of the subject invention are depicted in FIGS. 1 and 2. FIG. 1 illustrates an upper disc (10) of one embodiment of the subject invention. The upper disc has a cylindrical shaped aperture (14) centrally located therein and a first pin (12) protruding therefrom. FIG. 2 illustrates a lower disc (16) of one embodiment of the subject invention and a suction cup (22) centrally attached thereto. The lower disc has an arc-shaped slot (18) therein and a second pin (20) centrally located protruding therefrom. Pin ((20) is sized to reside within cylindrical shape aperture (14) when discs (10) and (16) are assembled.

Figure 3A:
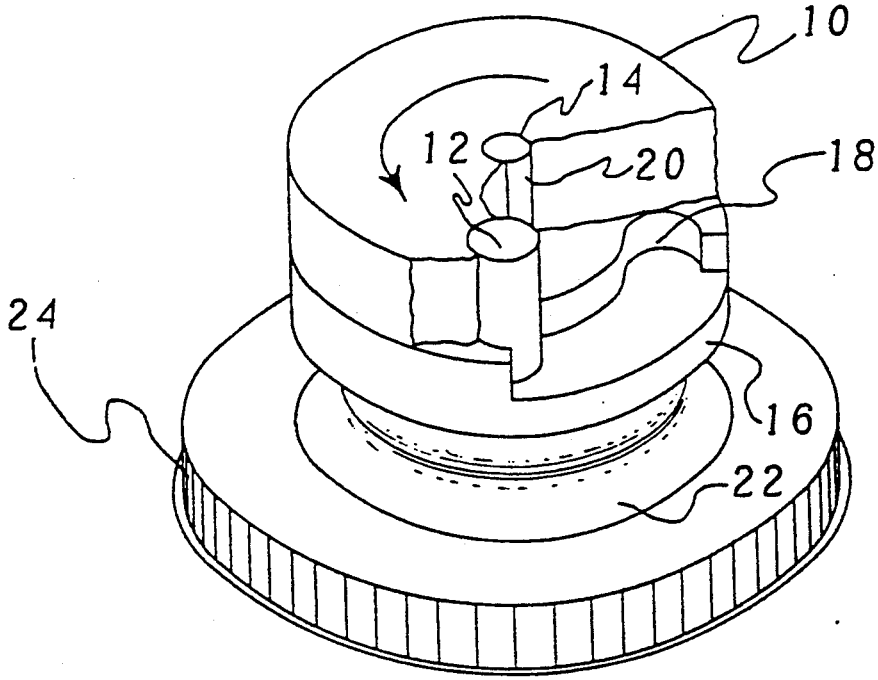
FIG. 3*a* is a perspective view of an assembled disc of the subject invention attached to a cap, the disc comprising the upper disc shown in FIG. 1 and the lower disc and suction cup shown in FIG. 2.

When the upper disc, lower disc and suction cup are assembled (see FIG. 3*a*), the second pin (20) of the lower disc (16) is inserted in the aperture (14) of the upper disc (10). The first pin (12) of the upper disc (10) is inserted into and is capable of freely rotating within the slot (18) of the lower disc (16). The suction cup (22) is shown attached to a cap (24) on a typically vacuum sealed container.

Figure 3B:
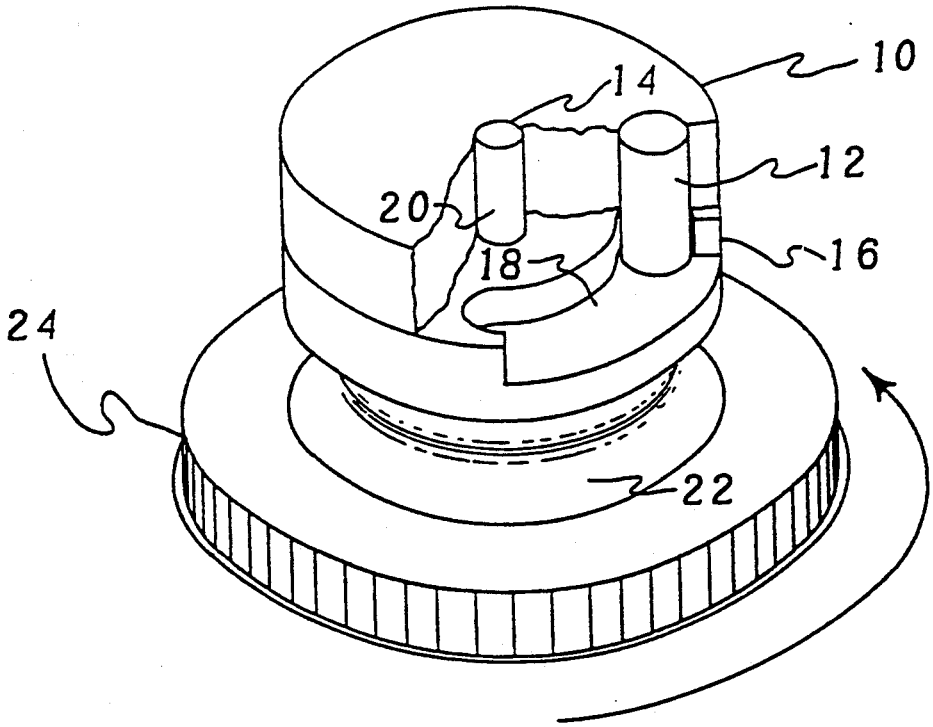
FIG. 3*b* is a perspective view of the assembled disc shown in FIG. 3*a* after the upper disc has been rotated in the counterclockwise direction as indicated.

FIG. 3*b* illustrates the effect of manually actuating the upper disc (10) in the counterclockwise direction as shown. The first pin (12) on the upper disc (10) rotates through the slot (18) until it contacts the lower disc (16). The contact applies a momentum based impulse and torque on the lower disc (16) resulting in both a driving and a striking force being applied to the suction cup (22), which in turn applies a force to the cap (24) to which the suction cup (22) is attached. The force applied to the cap will cause the cap to abruptly, but easily, loosen and the cap can then be removed.

Those skilled in the art to which the subject invention pertains will readily understand that the upper disc and the lower disc shown in FIGS. 1 and 2 may be of other suitable shapes. The invention comprises an upper section and a lower section, illustrated herein as an upper disc and a lower disc, or a single section which accomplishes the intent and purpose of the subject invention. The suction cup which is used to attach the lower disc to a cap could be any means suitable for removably attaching the lower section (or single section) to the cap. These include, but are not limited to, a spring with a clasp, or a V-shaped member attachable from the side of the cap. The second pin, the aperture, the first pin, and the slot, illustrated in FIGS. 3*a* and 3*b*, may be located in other suitable positions which may not be centrally and peripherally located, respectively.

Further, those skilled in the art will readily understand that the pin protruding from the lower disc could be replaced by an aperture in the lower disc with a corresponding pin in the upper disc. Additionally, the slot in the lower disc could be replaced with a pin in the lower disc which is inserted into a slot in the upper disc. The combination of these elements must provide for an upper section and a lower section, or a single section, wherein when the device is secured to a container cap, counterclockwise rotation of the upper section relative to the lower section applies a momentum based impulse and torque to the lower section, and thereby to the container cap, when the upper section reaches its limit relative to the lower section of counterclockwise rotation established by a means for restricting rotation of the upper section relative to lower section.

The device of the subject invention can also be used to tighten a cap on a container. When the device is secured to a container cap, clockwise rotation of the upper section relative to the lower section will apply momentum based impulse and torque to the lower section and thereby to the container cap, when the upper section reaches its limit relative to the lower section of clockwise rotation established by the restricting means.

The subject invention also provides a method of removing a cap from a container, the method including the use of a device having an upper section and a lower section, the upper section and the lower section being rotatably connected together, means for restricting rotation of the upper section relative to the lower section, and means for removably attaching the lower section to the container cap. The method comprises the steps of attaching a bottom surface of the lower section of the device to the container cap using the attachment means and manually actuating the upper section in a counterclockwise rotation relative to the lower section until the upper section reaches its limit, relative to the lower section, of counter-clockwise rotation established by the restricting means. This applies a momentum based impulse and torque to the lower section, the momentum based impulse and torque on the lower section transferring to the attachment means and the container cap. The container cap is thus rotated and removed in a counterclockwise rotation.

In a preferred embodiment of this method, the attachment means, such as a suction cup, is centrally attached to the container cap and to the bottom surface of the lower section, so that the cap and the device of the subject invention are axially aligned.

Although a preferred embodiment has been depicted and described in detail herein, it will be apparent to those skilled in the relevant art that various modifications, additions, substitutions, and the like can be made without departing from the spirit of the invention and these are therefore considered to be within the scope of the invention as defined in the following claims.

What is claimed is:

1. A device for removing a cap from a container, said device comprising:

a disc-shaped upper section and a disc-shaped lower section, said upper section being rotatable relative to said lower section;

means for restricting rotation of said upper section relative to said lower section; and means for removably attaching said lower section to the container cap; whereby when said device is secured to a container cap, counter-clockwise rotation of said upper section relative to said lower section applies a momentum based impulse and torque to said lower section, and thereby to said container cap, when said upper section reaches its limit of counterclockwise rotation relative to said lower section established by said restricting means.

2. The device of claim 1, wherein said lower section has a top surface and a bottom surface.

3. The device of claim 2, wherein said means for restricting rotation of said upper section relative to said lower section comprises a male and a female connection, said upper section having one of said male and said female connections and said lower section having the other of said male and said female connections.

4. The device of claim 3, wherein said male connection comprises a pin and said female connection comprises a radially curved slot in a portion of said upper or said lower section, said pin residing within said slot and being rotatable clockwise and counterclockwise therethrough.

5. The device of claim 4, wherein said pin and said slot are located at the periphery of said upper section and said lower section.

6. The device of claim 2, wherein said means for removably attaching said lower section to the container cap is centrally attached to the bottom surface of said lower section.

7. The device of claim 6, wherein said means for removably attaching said lower section to the container cap comprises a suction cup.

8. A device for removing a cap from a container, said device comprising:

a disc-shaped upper section and a disc-shaped lower section;

means for rotatably connecting said upper section to said lower section;

means for restricting rotation of said upper section relative to said lower section; and means for removably attaching in substantially fixed relation said lower section to the container cap;

whereby when said device is secured to a container cap, counter-clockwise rotation of said upper section relative to said lower section applies a momentus based impulse and torque to said lower section, and thereby to said container cap, when said upper section reaches its limit of counterclockwise rotation relative to said lower section established by said restricting means.

9. The device of claim 8, wherein said lower section has a top surface and a bottom surface.

10. The device of claim 9, wherein said means for rotatably connecting said upper section and said lower section comprises a first male and a first female connection, said upper section having one of said first male and said first female connections and said lower section having the other of said first male and said first female connections.

11. The device of claim 10, wherein said first male connection comprises a first pin and said first female connection comprises a cylindrical shaped aperture, said first pin being insertable into said aperture.

12. The device of claim 11, wherein said first pin and said aperture are centrally located in said upper section and said lower section.

13. The device of claim 12, wherein said means for restricting rotation of said upper section relative to said lower section comprises a second male and a second female connection, said upper section having one of said second male and said second female connections and said lower section having the other of said second male and said second female connections.

14. The device of claim 13, wherein said second male connection comprises a second pin and said second female connection comprises a radially curved slot in a portion of said upper or said lower section, said pin being inserted into said slot when said upper section is rotatably connected to said lower section, and said pin being rotatable clockwise and counterclockwise therethrough.

15. The device of claim 14, wherein said second pin and said slot are located at the periphery of said upper section and said lower sections.

16. The device of claim 15, wherein said means for removably attaching said lower section to the container cap is centrally attached to the bottom surface of said lower section.

17. The device of claim 16, wherein said means for removably attaching said lower section to the container cap comprises a suction cup.

18. A method of removing a cap from a container, said method including the use of a device having an upper section and a lower section, said upper section and said lower section being rotatably connected together, said device also including means for restricting rotation of said upper section relative to said lower section, and means for removably attaching said lower section to the container cap such that said lower section is substantially fixed relative to said cap, said method comprising the steps of:

a) attaching said lower section of said device to said container cap using said attachment means, and b) manually actuating said upper section in a counterclockwise rotation relative to said lower section until said upper section reaches its limit of counterclockwise rotation relative to said lower section established by said restricting means, thereby applying a momentum based impulse and torque to said lower section, said momentum based impulse and torque on said lower section transferring to said attachment means and thereby said container cap, thus rotating and removing said container cap.

19. The method of claim 18, wherein said attachment means is centrally attached to said container cap and to said bottom surface of said lower section.

* * * * *